US006874853B2

(12) United States Patent
Wild

(10) Patent No.: US 6,874,853 B2
(45) Date of Patent: Apr. 5, 2005

(54) CHAIR

(75) Inventor: Konrad Wild, Engelthalt (DE)

(73) Assignee: Dauphin Entwicklungs- u. Beteiligungs-GmbH, Neukirchen (DE)

( * ) Notice: Subject to any disclaimer, the term of this patent is extended or adjusted under 35 U.S.C. 154(b) by 128 days.

(21) Appl. No.: 10/337,875

(22) Filed: Jan. 8, 2003

(65) Prior Publication Data

US 2003/0127897 A1 Jul. 10, 2003

(30) Foreign Application Priority Data

Jan. 8, 2002 (DE) ..... 102 00 358

(51) Int. Cl.[7] ..... A47C 1/024

(52) U.S. Cl. ..... 297/300.2; 297/300.1; 297/300.4; 297/300.8; 297/301.4; 297/302.1; 297/300.3; 297/303.1

(58) Field of Search ..... 297/300.2, 300.1, 297/300.4, 300.3, 301.4, 302.1, 300.5, 300.7, 300.8, 303.1, 303.4

(56) References Cited

U.S. PATENT DOCUMENTS

| | | | | | |
|---|---|---|---|---|---|
| 4,641,886 | A | * | 2/1987 | Dauphin | 297/300.3 |
| 5,447,357 | A | * | 9/1995 | Dauphin | 297/301.4 |
| 5,964,503 | A | | 10/1999 | Inoue | |
| 6,572,191 | B2 | * | 6/2003 | Wild | 297/301.4 |
| 6,588,843 | B1 | * | 7/2003 | Ebenstein | 297/300.1 |

FOREIGN PATENT DOCUMENTS

| | | |
|---|---|---|
| DE | 42 09 049 | 9/1993 |
| DE | 43 24 545 | 1/1995 |
| EP | 0 584 620 A | 3/1994 |

OTHER PUBLICATIONS

Anzeige der Ergenbnisse aus WPINDEX Datenbank, "Work Chair with Synchronous Adjuster for Backrest and Seat", Kloeber GmbH & Co., DE4209049 (Abstract).

Anzeige der Ergenbnisse aus WPINDEX Datenbank, "Office Chair with Chair Column Protruding from Base," Trenoffice Bueromoebe GmbH & Co. KG, DE4324545 (Abstract).

* cited by examiner

*Primary Examiner*—Laurie K. Cranmer
(74) *Attorney, Agent, or Firm*—Browdy and Neimark, P.L.L.C.

(57) ABSTRACT

This object is attained in a chair comprising a pedestal; a seat support supported thereon via a chair column, said seat support comprising a front and a rear seat support element being connected with one another via a pivot axis extending substantially horizontally; a seat supported on said seat support elements; a backrest secured on said rear seat support element; a longitudinally adjustable energy storing means for mutually adjusting said backrest and said seat, said energy storing means being joined with said seat support elements at a distance from their pivot axis; a spring abutment being arranged pivotably around said pivot axis for adjustably dampening a pivoting movement of said seat support elements relative to one another; an adjusting element extending substantially tangentially relative to said pivot axis and being pivotable around an adjusting element pivot axis for modifying the bias between said spring abutment and one seat support element; and an actuating twist handle connected with said adjusting element and pivotable around a twist handle pivot axis for manually turning said adjusting element. Said actuating twist handle is connected via a coupling element with said adjusting element for transmitting a turning movement. Said adjusting element pivot axis and said twist handle pivot axis are not flush with one another.

29 Claims, 3 Drawing Sheets

CHAIR

BACKGROUND OF THE INVENTION

1. Field of the Invention

The invention relates to a chair, in particular an office chair.

2. Background Art

A chair of the generic type is known from U.S. Pat. No. 5,447,357. It has a seat that is supported on two seat support elements which are pivotable relative to one another. Hard or soft pivotability of the seat support elements relative to one another is determined by a spring abutment, the action of which is modifiable by an adjusting screw. The adjusting screw is extended downwards from the rear seat support element, its outer end being provided with a twist handle. For modification of the action of the spring abutment, a user must get off a chair and operate the twist handle.

SUMMARY OF THE INVENTION

It is an object of the invention to further develop a chair of the generic type in such a way that adjusting the action of the spring abutment is as simple as possible.

This object is attained in a chair comprising a pedestal; a seat support supported thereon via a chair column, said seat support comprising a front and a rear seat support element being connected with one another via a pivot axis extending substantially horizontally; a seat supported on said seat support elements; a backrest secured on said rear seat support element; a longitudinally adjustable energy storing means for mutually adjusting said backrest and said seat, said energy storing means being joined with said seat support elements at a distance from their pivot axis; a spring abutment being arranged pivotably around said pivot axis for adjustably dampening a pivoting movement of said seat support elements relative to one another; an adjusting element extending substantially tangentially relative to said pivot axis and being pivotable around an adjusting element pivot axis for modifying the bias between said spring abutment and one seat support element; and an actuating twist handle connected with said adjusting element and pivotable around a twist handle pivot axis for manually turning said adjusting element. Said actuating twist handle is connected via a coupling element with said adjusting element for transmitting a turning movement. Said adjusting element pivot axis and said twist handle pivot axis are not flush with one another.

The gist of the invention resides in that a coupler is provided between the adjusting element and the twist handle, the coupler allowing a turning moment to be transmitted from the twist handle to the adjusting element, there being no need for the axis of rotation of the adjusting element to align with the axis of rotation of the twist handle.

Additional features and details of the invention will become apparent from the description of an exemplary embodiment taken in conjunction with the drawing.

DESCRIPTION OF THE PREFERRED EMBODIMENT

Figure 1:
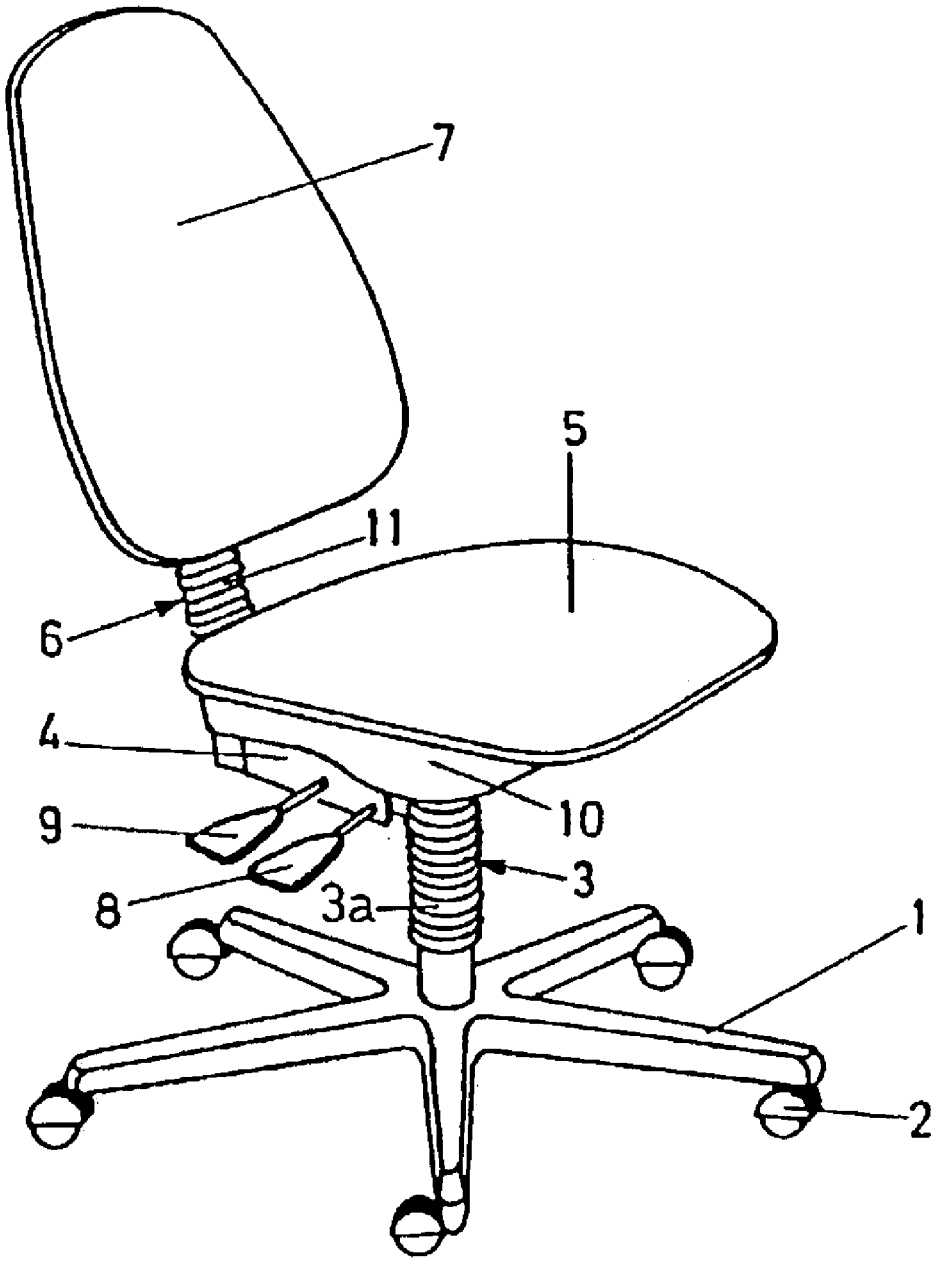
FIG. 1 is a perspective view of an office chair according to the invention.

An office chair illustrated in FIG. 1 comprises a pedestal 1, supported via casters 2 on the ground. An adjustable-height chair column 3 which is surrounded by bellows 3*a* is attached to the pedestal 1. To the upper end of the chair column 3 a seat support 4 is detachably secured, on which an upholstered seat 5 is disposed. A backrest support 6, which extends substantially upwards and to the upper end of which a backrest 7 is secured, is arranged on the seat support 4. Height adjustment of the chair column 3 is performed by means of an operating lever 8. For the purpose of changing the inclination of the backrest 7, together with the backrest support 6, while simultaneously changing the inclination of the seat 5, a further actuating lever 9 is mounted on the seat support 4. The seat support 4 may be partially or substantially covered optically by a casing 10 arranged on the bottom side of the seat 5. As can be seen from FIG. 1, the backrest support 6 is coated by bellows 11 for optical reasons.

The described basic construction of the office chair is generally known. The adjustable-height chair column 3 is known for instance from U.S. Pat. No. 3,711,054 or from U.S. Pat. No. 3,656,593. The construction of the seat support 4, including the described pivoting possibilities of backrest 7 and seat 5, is known for instance from EP-PS 0 179 185 (corresponding to U.S. Pat. Nos. 4,966,412, 4,662,680 and 4,641,886).

Figure 2:
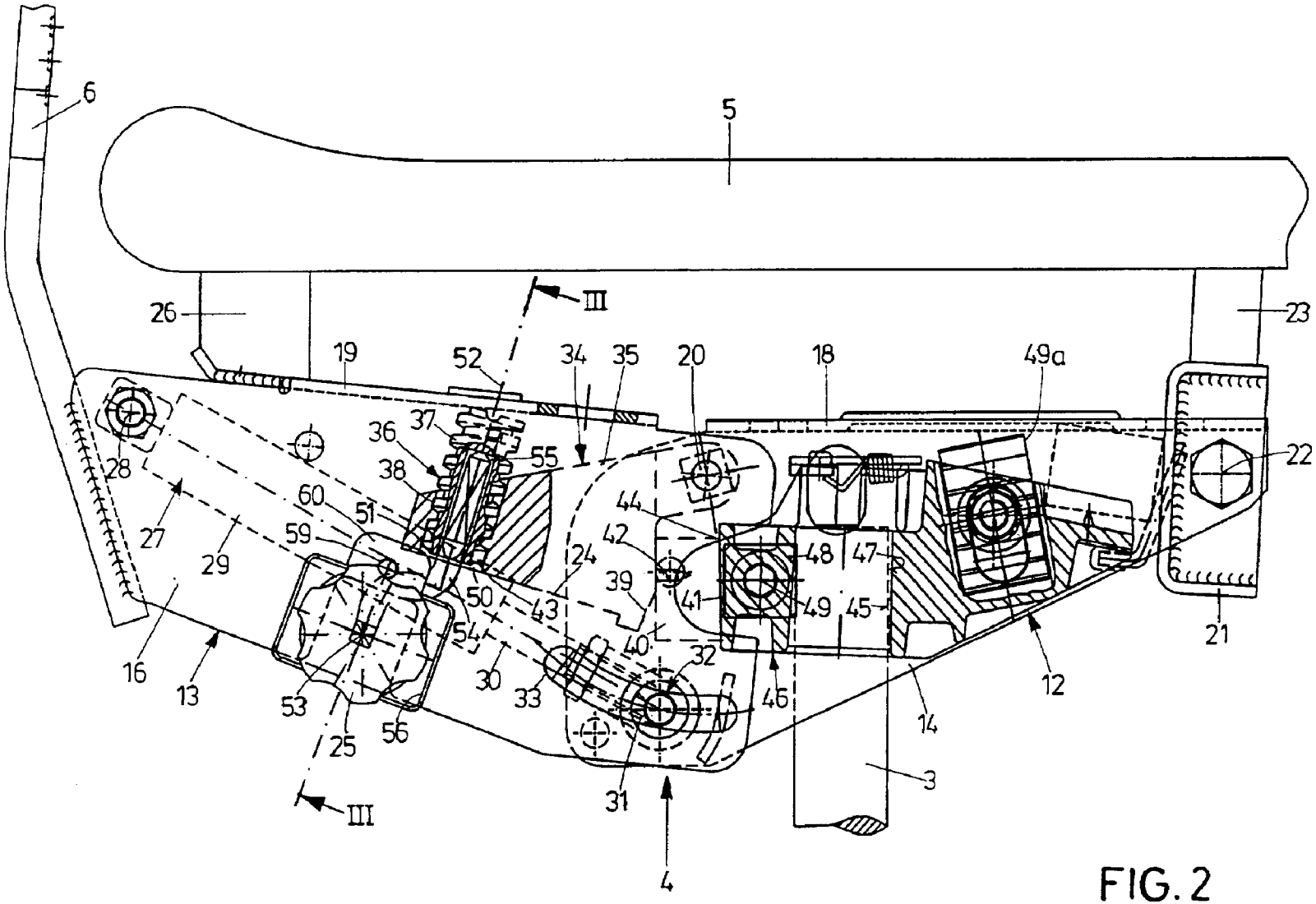
FIG. 2 is a lateral view of the seat substructure of the office chair according to the invention.
Figure 3:
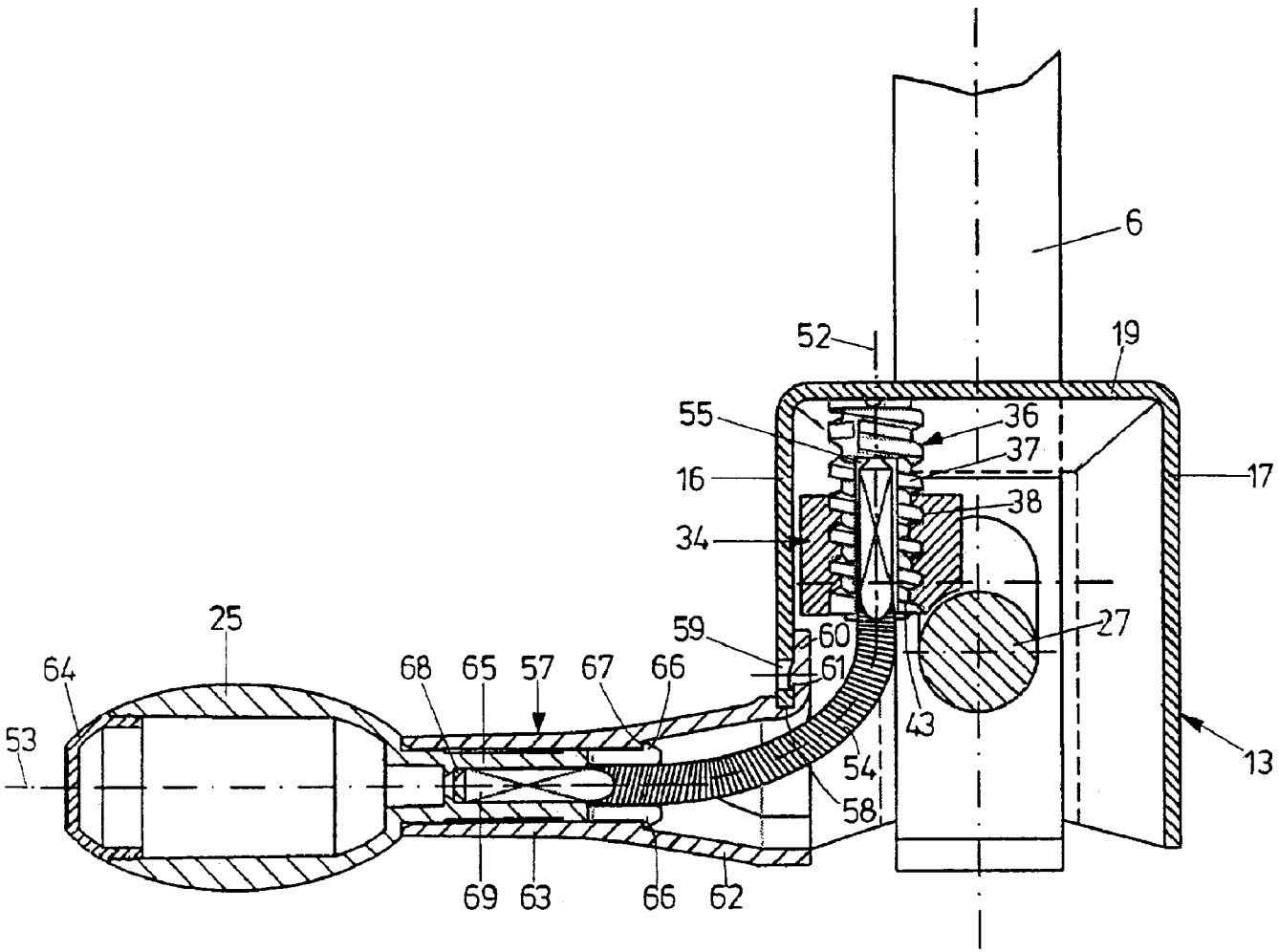
FIG. 3 is a sectional view on the line III—III of FIG. 2.

As can be seen from FIGS. 2 and 3, the seat support 4 is divided. It consists of a front seat support element 12 and a rear seat support element 13, which have a substantially U-shaped cross section which is open downwards. This results in that they comprise two side walls 14, 15 or 16, 17, respectively, which are interconnected by bottoms 18 or 19, respectively, that faces the seat 5. The two seat support elements 12, 13 are interconnected by a pivot axis 20 that is arranged adjacent to their bottoms 18, 19.

On the front end of the seat support 4, a seat holder 21 is arranged to be pivotable about a pivot axis 22, the seat holder 21 being formed by a profile extending at right angles to the main plane of symmetry of the chair, i.e. at right angles to the plane of the drawing of FIG. 2. On this seat holder 21, the seat 5 is supported via spacers 23. The seat 5 is supported on, and secured to, the bottom 19 of the rear seat support element 13 by means of elastic buffers 26.

On the rear end of the rear seat support element 13, i.e. in the region where the backrest support 6 is secured to the rear seat support element 13, a longitudinally adjustable energy storing device in the form of a longitudinally adjustable gas spring 27 is articulated about a pivot axis 28, which is parallel to the pivot axes 20 and 22. The housing 29 of the gas spring 27 faces this pivot axis 28, a piston rod 30 being extracted from the other end of the gas spring 27. An actuating pin 31, by means of which a valve that is located in the gas spring can be actuated for length adjustment, protrudes from the piston rod 30. By means of a thread the piston rod 30 is connected with an actuating device 32 which includes the actuating lever 9. This actuating device 32 is supported between the side walls 14, 15 of the front seat support element 12 to be pivotable parallel to the pivot axes 20, 22, 28. The actuating lever 9 is guided through and out of an oblong hole 33 in the associated side wall 16 of the rear seat support element 13, this oblong hole 33 being curved in such a manner that its center coincides with the pivot axis 20. Any length adjustment of the gas spring 27 will result in the front seat support element 12 and the rear seat support element 13 being pivoted relative to each other about the pivot axis 20, which on the one hand causes the inclination of the seat 5 to be changed and on the other hand the backrest support 6 with the backrest 7 to be pivoted simultaneously. Devices of this type are designated as so-called synchronous mechanisms. If the actuating pin 31 is pushed into the piston rod 30 of the gas spring 27 not just for a short time in order to achieve a change of length of the gas spring 27 and thus a change of the position of the seat 5 and the backrest 7, but if the actuating pin 31 is pushed into the piston rod 30 for a prolonged time, then the seat 5 together with the backrest 7 can be tilted.

The construction of the seat support 4 with the seat 5—as far as it has been described—is known from EP-PS 0 179 185 (corresponding to U.S. Pat. Nos. 4,966,412, 4,662,680 and 4,641,886). The construction and arrangement of the actuating device 32 and of the gas spring 27 are known from EP-OS 0 179 216 (corresponding to U.S. Pat. Nos. 4,966, 412, 4,662,680 and 4,641,886).

A spring abutment 34 of angle-lever-type cross-sectional design is supported to pivot about the pivot axis 20 of the front and rear seat support element 12 or 13, respectively. An abutment lever 35 extends from the pivot axis 20 backwards, i.e. in the direction towards the backrest support 6, underneath the bottom 19 of the rear seat support element 13.

By means of its external thread 37, an adjusting screw 36 is arranged in an internal thread 38 on the abutment lever 35 in the vicinity of the free end thereof. The threads 37, 38 are not self-locking. The free end of the adjusting screw 36 supports itself on the bottom 19 of the rear seat support element 13.

The other abutment lever 39, which extends approximately vertically of the lever 35 downwards from the pivot axis 20, bears against a spring 40 formed by a block of elastic material, for example a celled polyurethane elastomer that is commercially available under the designation Vulkocell. The other end of this spring 40 abuts against a stationary, however pivotable abutment 41, which is formed by a rear wall, located opposite the lever 39, of the bearing element 46 that is described in detail below. The spring 40 is secured to a pin-like projection 42 of the lever 39 so that it cannot fall out downwardly from the region between the lever 39 and the abutment 41.

If—as is shown in FIG. 2—the external thread 37 of the adjusting screw 36 is completely screwed through the internal thread 38 of the spring abutment 34, the abutment lever 39 is in its position next to the abutment 41, i.e. the spring 40 is biased most strongly. Once again it is emphasized that the abutment 41 is arranged within the front seat support element 12.

If, with the gas spring 27 unlocked, the backrest 6 is pivoted backwards, the portions located below the pivot axis 20 of the front and the rear seat support elements 12 or 13, respectively, are pivoted towards each other, i.e. the spring 40 is compressed more strongly while this backward pivoting movement of the backrest 7 is progressively damped. This counterforce of the spring 40 thus progressively counteracts the backward pivoting motion of the backrest 7. When the backrest 7 is relieved, its pivoting forward is assisted by a corresponding release of the spring 40, this assisting force diminishing while the backrest 7 pivots forward.

If the adjusting screw 36 is screwed downwardly out of the abutment lever 35 so far that its pilot end 43 is approximately flush with the lever 35, the spring 40 cannot be effective throughout possible range of pivoting of the front and the rear seat support element 12, 13 i.e., it is not compressed between the abutment 41 and the abutment lever 39 while producing a corresponding counterforce.

In any intermediate positions of the adjusting screw 36, the spring 40 is engaged in case of correspondingly varying pivoting positions of the rear seat support element 13 in relation to the front seat support element 12, i.e. in the case of varying backward inclinations of the backrest 7 and thus of the seat 5. In addition, in these intermediate positions, at first only an edge 44 of the block-like spring 40 rests on the abutment 41, this contact being steadily increased by any further pivoting motion until it reaches full-face rest on the abutment 41. This gives also rise to a certain progression in spring action being achieved.

For the spring abutment 34 to be inherently resistant to bending, the levers 35, 39 are reinforced by one or several intermediate webs 24. In order to prevent the adjusting screw 36 from being inadvertently screwed out of the internal thread 38, its external thread is slit and pinched in usual manner in the vicinity of its end 43. In order to permit easy operation of the adjusting screw 36, it is provided with a twist handle 25 on its end protruding laterally out of the seat support 4. The adjusting screw 36 is displaced in relation to the gas spring 27. The gas springs 27 are commercially available and are generally known with regard to construction and mode of operation for instance from DE-PS 18 12 282 (corresponding to U.S. Pat. No. 3,656, 593).

For additional adjustment of inclination of the entire seat 5 by the synchronous mechanism, the front seat support element 12 is articulated to the upper end, forming a bearing cone 45, of the chair column 3 via a bearing element designated as 46 in its entirety. The bearing element 46 of aluminum diecasting is seated by an internally cone-shaped bearing block 47 on the bearing cone 45 of the chair column 3. The bearing block 47 is fastened in a longitudinally oriented rectangular tube 48, which, on its side located downstream of the bearing block 47, supports an articular axis 49 in the form of a simple screw and nut that is parallel to the pivot axis 20. The front seat support element 12 is articulated to this articular axis 49.

For arrest of the seat 5 in a certain inclined position, the front seat support element 12 is provided with a rack detent arrangement 49*a*, which is disposed before the bearing block 47, acting between the front seat support element 12 and the bearing element 46. The exact design of the rack detent arrangement 49*a* is described in EP 1 169 947 A1 (corresponding to US 2002/0003367 A1), to the specification of which reference is made. It is also possible to embody the detent arrangement as an arrangement of lamellar packs, as known from U.S. Pat. No. 5,447,357.

The following is a detailed description of the structure of the spring abutment 34. The adjusting screw 36 is throughout provided with the external thread 37. Starting from the bottom 19, the adjusting screw 36 reaches as far as to where the lower edge 50 of the internal thread 38 extends when the spring abutment 34 is in its outward pivoted position. The external thread 37 may also be slightly longer. The lower end 51 of the adjusting screw 36 is located within the rear seat support element 13. The adjusting screw 36 takes the function of a regulating element which, as explained above, modifies the pre-load between the spring abutment 34 and the seat support element 12. The adjusting screw 36 is rotatable about an axis of rotation 52. The twist handle 25, which is rotatable about an axis of rotation 53, is non-rotatably connected to the adjusting screw 36 by way of a spring shaft 54 in the form of a coupler. The spring shaft 54 may be a flexible shaft of the type of a helical spring suitable for torque transmission. It is also conceivable to use two rigid shaft segments that are interconnected by a universal joint in the place of the spring shaft 54. To this end, the adjusting screw 36 comprises a centric blind hole 55, which is open downwards and in which an end of the spring shaft 54 is fixed against rotation.

For the twist handle 25 to be mounted on the seat support element 13, a rectangular recess 56, which is open downwards, is provided in the side wall 16. A bearing sleeve 57 is fixed to the edge of the recess 56 and projects outwards. In the side wall 16 region, the bearing sleeve 57 on the three sides of a rectangular facing the side wall 16 a circumferential groove 58 into which the side wall 16 engages. In this way, the bearing sleeve 57 is fixed along the pivot axis 53, perpendicularly upward from it and horizontally interlocking. Above the recess 56, a bore 59 is provided in the side wall 16. A plate 60 being connected with the bearing sleeve 57 and extending upward from it at the inner side of the side wall 16 comprises a locking heel 61 projecting outward and being in a locking engagement with the bore 59 while also fixing the bearing sleeve 57 relative to the seat support element 13 against a downward pulling force. The bearing sleeve 57 comprises a portion 62 conically tapering from the side wall 15 to the outside and an adjacent annular cylindrical portion 63 having a substantially constant diameter. The twist handle 25 is hollow and closed at its end side by a lid 64 locked thereon. In the side of the twist handle 25 facing the side wall 16, a projecting pin 65 is provided which comprises at its free end a radially outward projecting locking edge 66. The pin 65 is turnably positioned in the portion 63 wherein the locking edges 66 come into an interlocking engagement with corresponding projections 67 formed on the inner side of the portion 63 to prevent the twist handle 25 from being pulled off to the outside. In the pin 65, a pocket bore 68 is provided in which the outer end 69 of the spring shaft 54 is fixed to prevent its rotation. The axis of rotation 53 extends substantially perpendicular to the axis of rotation 52. However, it is also possible to have the twist handle 25 project laterally from the seat support element 13 at a different angle. In any case, the axis of rotation 53 is not flush with the axis of rotation 52. In the most simple case, the recess 56 is provided centrally below the adjusting screw 36 so that the spring shaft is deviated by only 90°. Other requirements such as ease of use which specify that the twist handle 25 is to be arranged at another longitudinal position beneath the seat 5 may necessitate an offset of the recess 56 from the adjusting screw 36. In this case, the flexible spring shaft 54 is able to manage the offset as well as the deviation of the turning movement from the horizontal to the vertical direction. By twisting the twist handle 25, the adjusting screw 36 is turned so that the position of the spring abutment 34 changes. As described in detail above, this modifies the hardness of a pivoting movement of the backrest 7 relative to the seat 5.

The particular advantage of having the twist handle 25 project laterally outward is that the adjustment of the adjusting screw 36 can be performed more comfortably. In particular, such adjustment can be performed when a person is sitting on the chair. This is especially advantageous as the person, while modifying the hardness, is able to carry out pivoting movements with the chair.

What is claimed is:

1. A chair, in particular an office chair, comprising a pedestal (1), a seat support (4) supported thereon via chair column (3), said seat support (4) comprising a front and a rear seat support element (12, 13) being connected with one another via a pivot axis (20) extending substantially horizontally, a seat (5) supported on said seat support elements (12, 13), a backrest (7) secured on said rear seat support element (13), a longitudinally adjustable energy storing means (27) for mutually adjusting said backrest (7) and said seat (5), said energy storing means (27) beingjoined with said seat support elements (12, 13) at a distance from their pivot axis (20), a spring abutment (34) being arranged pivotably around said pivot axis (20) for adjustably dampening a pivoting movement of said seat support elements (12, 13) relative to one another, an adjusting element (36) extending substantially tangentially relative to said pivot axis (20) and being pivotable around an adjusting element pivot axis (52) for modifying the bias between said spring abutment (34) and one seat support element (12), and an actuating twist handle (25) connected with said adjusting element (36) and pivotable around a twist handle pivot axis (53) for manually turning said adjusting element, wherein said actuating twist handle (25) is connected via a coupling element (54) with said adjusting element for transmitting a turning, movement, and wherein said adjusting element pivot axis (52) and said twist handle pivot axis (53) are not coaxial with one another.

2. A chair according to claim 1, wherein said coupling element is formed as a flexible shaft.

3. A chair according to claim 1, wherein said coupling element is formed as a spring shaft (54).

4. A chair according to claim 1, wherein said actuating twist handle (25) extends laterally from one seat support element (13).

5. A chair according to claim 1, wherein said adjusting element is formed as an adjusting screw (36).

6. A chair according to claim 5, wherein said coupling element is secured in a recess (55) of said adjusting screw (36).

7. A chair according to claim 1, wherein a lateral opening (56) is provided in one seat support element (13) through which said coupling element extends to the outside.

8. A chair according to claim 1, wherein said actuating twist handle (25) is turnably mounted in a bearing sleeve (57).

9. A chair according to claim 8, wherein said bearing sleeve (57) is secured on one seat support element (13).

10. A chair according to claim 9, wherein said bearing sleeve (57) is secured by an interlocking connection.

11. A chair, in particular an office chair, comprising a pedestal (1), a seat support (4) supported thereon via chair column (3), said seat support (4) comprising a front and a rear seat support element (12, 13) being connected with one another via a pivot axis (20) extending substantially horizontally, a seat (5) supported on said seat support elements (12, 13), a backrest (7) secured on said rear seat support element (13), a longitudinally adjustable energy storing means (27) for mutually adjusting said backrest (7) and said seat (5), said energy storing means (27) being joined with said seat support elements (12, 13) at a distance from their pivot axis (20), a spring abutment (34) being arranged pivotably around said pivot axis (20) for adjustably dampening a pivoting movement of said seat support elements (12, 13) relative to one another, an adjusting element extending substantially tangentially relative to said pivot axis (20) and being pivotable around an adjusting element pivot axis (52) for modifying the bias between said spring abutment (34) and one seat support element (12), and an actuating twist handle (25) connected with said adjusting element and pivotable around a twist handle pivot axis (53) for manually turning said adjusting element, wherein said seat support (13) has a substantially U-shaped cross section, wherein said seat support (13) has side walls (16, 17) and a bottom (19) interconnecting said side walls (16, 17) and facing said seat (5), wherein said actuating twist handle (25) is connected via a coupling element with said adjusting element for transmitting a turning movement, wherein said actuating twist handle (25) extends laterally from said side wall (16), and wherein said adjusting element pivot axis (52) and said twist handle pivot axis (53) are not coaxial with one another.

12. A chair according to claim 11, wherein said coupling element is formed as a flexible shaft.

13. A chair according to claim 11, wherein said coupling element is formed as a spring shaft (54).

14. A chair according to claim 11, wherein said adjusting element is formed as an adjusting screw (36).

15. A chair according to claim 14, wherein said coupling element is secured in a recess (55) of said adjusting screw (36).

16. A chair according to claim 11, wherein a lateral opening (56) is provided in one seat support element (13) through which said coupling element extends to the outside.

17. A chair according to claim 11, wherein said actuating twist handle (25) is turnably mounted in a bearing sleeve (57).

18. A chair according to claim 17, wherein said bearing sleeve (57) is secured on one seat support element (13).

19. A chair according to claim 18, wherein said bearing sleeve (57) is secured by an interlocking connection.

20. A chair, in particular an office chair, comprising a pedestal (1), a seat support (4) supported thereon via a chair column (3), said seat support (4) comprising a front and a rear seat support element (12, 13) being connected with one another via a pivot axis (20) extending substantially horizontally, a seat (5) supported on said seat support elements (12, 13), a backrest (7) secured on said rear seat support element (13), a longitudinally adjustable energy storing means (27) for mutually adjusting said backrest (7) and said seat (5), said energy storing means (27) being joined with said seat support elements (12, 13) at a distance from their pivot axis (20), a spring abutment (34) being arranged pivotably around said pivot axis (20) for adjustably dampening a pivoting movement of said seat support elements (12, 13) relative to one another, an adjusting element extending substantially tangentially relative to said pivot axis (20) and being pivotable around an adjusting element pivot axis (52) for modifying the bias between said spring abutment (34) and one seat support element (12), and an actuating twist handle (25) connected with said adjusting element and pivotable around a twist handle pivot axis (53) for manually turning said adjusting element, wherein said actuating twist handle (25) is connected via a coupling element with said adjusting element for transmitting a turning movement, wherein said coupling element is formed as a spring shaft (54) and wherein said adjusting element pivot axis (52) and said twist handle pivot axis (53) are not coaxial with one another.

21. A chair according to claim 20, wherein said coupling element is formed as a flexible shaft.

22. A chair according to claim 20, wherein said actuating twist handle (25) extends laterally from one seat support element (13).

23. A chair according to claim 20, wherein said adjusting element is formed as an adjusting screw (36).

24. A chair according to claim 23, wherein said coupling element is secured in a recess (55) of said adjusting screw (36).

25. A chair according to claim 20, wherein a lateral opening (56) is provided in one seat support element (13) through which said coupling element extends to the outside.

26. A chair according to claim 20, wherein said actuating twist handle (25) is turnably mounted in a bearing sleeve (57).

27. A chair according to claim 26, wherein said bearing sleeve (57) is secured on one seat support element (13).

28. A chair according to claim 27, wherein said bearing sleeve (57) is secured by an interlocking connection.

29. A chair, in particular an office chair, comprising a pedestal (1), a seat support (4) supported thereon via a chair column (3), said seat support (4) comprising a front and a rear seat support element (12, 13) being connected with one another via a pivot axis (20) extending substantially horizontally, a seat (5) supported on said seat support elements (12, 13), a backrest (7) secured on said rear seat support element (13), a longitudinally adjustable energy storing means (27) for mutually adjusting said backrest (7) and said seat (5), said energy storing means (27) being joined with said seat support elements (12, 13) at a distance from their pivot axis (20), a spring abutment (34) being arranged pivotably around said pivot axis (20) for adjustably dampening a pivoting movement of said seat support elements (12, 13) relative to one another, an adjusting element extending substantially tangentially relative to said pivot axis (20) and being pivotable around an adjusting element pivot axis (52) for modifying the bias between said spring abutment (34) and one seat support element (12), and an actuating twist handle (25) connected with said adjusting element and pivotable around a twist handle pivot axis (53) for manually turning said adjusting element, wherein said actuating twist handle (25) is connected via a coupling element with said adjusting element for transmitting a turning movement, wherein said adjusting element is formed as an adjusting screw (36), wherein said coupling element is secured in a recess (55) of said adjusting screw (36) and wherein said adjusting element pivot axis (52) and said twist handle pivot axis (53) are not coaxial with one another.

* * * * *